United States Patent [19]

Beckett

[11] 4,370,949

[45] Feb. 1, 1983

[54] WASTE HEAT RECOVERY SYSTEM

[76] Inventor: Ardell Beckett, 307 Moore Dr., R.R. #1, Ridgeville, Ontario, Canada, L0S 1M0

[21] Appl. No.: 119,725

[22] Filed: Feb. 8, 1980

[30] Foreign Application Priority Data

Nov. 21, 1979 [CA] Canada ..... 340337

[51] Int. Cl.[3] ..... F22B 33/00

[52] U.S. Cl. ..... 122/20 B; 165/134 DP; 165/DIG. 12; 165/39; 237/8 R; 237/9 R

[58] Field of Search ..... 237/55, 8 R, 9 R, 13; 165/DIG. 2, DIG. 12, 134 DP, 39; 122/DIG. 1, 20 B; 126/101

[56] References Cited

U.S. PATENT DOCUMENTS

| | | | |
|---|---|---|---|
| 196,597 | 10/1877 | Rivera | 122/20 B |
| 1,633,759 | 6/1927 | Breese | 122/20 B |
| 2,074,989 | 3/1937 | Orban | 122/20 B |
| 2,369,972 | 2/1945 | Meagher | 237/19 |
| 3,033,192 | 5/1962 | Bogren | 237/19 |
| 4,037,786 | 7/1977 | Munroe | 237/19 |
| 4,048,962 | 9/1977 | Pristelski | 122/20 B |
| 4,258,878 | 3/1981 | Van Pachtenbeke | 122/20 B X |

FOREIGN PATENT DOCUMENTS

| | | | |
|---|---|---|---|
| 823923 | 9/1969 | Canada | 122/20 B |
| 1024841 | 1/1978 | Canada | 122/20 B |

OTHER PUBLICATIONS

Stewart, D., "Fuel Energy Management Techniques", Paper Presented at Annual Convention of Ontario Hospital Association, Nov. 1978.

*Primary Examiner*—Albert J. Makay
*Assistant Examiner*—Henry Bennett
*Attorney, Agent, or Firm*—Beveridge, De Grandi & Kline

[57] ABSTRACT

This invention relates to a system for reclaiming or recovering heat which would otherwise be lost from a heating plant. The invention accordingly relates to a heating plant incorporating a plurality of boilers, including a stand-by boiler, there being means for supplying fuel and air to at least one of said boilers, except for the stand-by boiler, and flue gas exhaust ducts associated with each of such boilers. The improvement according to the invention is a waste heat recovery system wherein the flue gas exhaust duct from said at least one boiler is operatively connected to the stand-by boiler for the circulation of hot flue gases therethrough in contact with its heat exchange surfaces thereby to effect the heating of water passing through the stand-by boiler thereby to recover a portion of the heat energy in the flue gases. The system further includes a means for controlling the temperature of the water in the stand-by boiler at temperatures above those necessary to avoid excessive cooling of the flue gases within the stand-by boiler and consequent undesired condensation of certain flue gas components on its heat exchange surfaces.

13 Claims, 5 Drawing Figures

WASTE HEAT RECOVERY SYSTEM

This invention relates to a system for reclaiming or recovering heat which would otherwise be lost from a heating plant.

Rapidly arising fuel costs, and the scarcity of fuel supplies in many areas have led to a need for energy conservation. The present invention concerns a system for recovering heat from exhaust or combustion gases and utilizing such recovered heat energy to supply a portion of a heating load. The system according to the invention is suitable for use in conjunction with plants employing steam boilers having exhaust gas temperatures which are relatively high, e.g. in the order of 450°-700° F. This system can be used in a wide variety of heating plants provided that a plurality of boilers are utilized and further provided that one of such boilers is available for use for substantial periods of time on a stand-by basis. The system can be used in the heating plants of hospitals, schools, factories, office buildings and various types of commercial establishments.

The invention accordingly relates to a heating plant incorporating a plurality of boilers, including a stand-by boiler, there being means for supplying fuel and air to at least one of said boilers, except for the stand-by boiler, and flue gas exhaust ducts associated with each of such boilers. The improvement according to the invention is a waste heat recovery system wherein the flue gas exhaust duct from said at least one boiler is operatively connected to the stand-by boiler for the circulation of hot flue gases therethrough in contact with its heat exchange surfaces thereby to effect the heating of water passing through the stand-by boiler thereby to recover a portion of the heat energy in the flue gases. The system further includes a means for controlling the temperature of the water in the stand-by boiler at temperatures above those necessary to avoid excessive cooling of the flue gases within the stand-by boiler and consequent undesired condensation of certain flue gas components on its heat exchange surfaces.

In a preferred form of the invention, the above-noted flue gas exhaust duct includes a first section connected to and leading into the stand-by boiler and a second section which is capable of by-passing the flue gases around the stand-by boiler. The above-noted temperature controlling means preferably includes a damper system disposed in the exhaust duct for controlling the proportions of flue gases to be passed through the first and second duct sections. Means are provided which are responsive to the temperature of the water passing through the stand-by boiler and are operatively connected to the damper means for controlling the amount of flue gases passing through the stand-by boiler.

In a typical embodiment of the invention, the first section of the exhaust duct is connected to the stand-by boiler to lead the exhaust gases into the combustion chamber of same, the first section of the exhaust duct having a removable portion therein arranged to permit the first section to be disconnected and closed off and a fuel firing assembly to be operatively brought into communication with the combustion chamber of the stand-by boiler as when the latter is required to produce steam.

In a typical system according to the invention, said at least one boiler is connected via a steam header to a heat exchanger with a water heating circuit for the building being operatively connected to the heat exchanger. A further water circuit means is provided for connecting the stand-by boiler in flow relation with the building heating circuit. First and second control valve means and associated control system means are provided for regulating the steam flow through said header and for regulating the flow through the stand-by boiler water circuit respectively. The above-noted means provide a desired temperature in the water outflow from the heat exchanger while assisting in maintaining the water flowing through the stand-by boiler above a minimum selected temperature.

Preferably, the above-noted control system is responsive to stand-by boiler water temperature and to the water temperature leaving the heat exchanger. The control system acts to eliminate water flow through the stand-by boiler when the water is below a minimum selected temperature and, after the minimum selected temperature is reached, the control system becomes primarily responsive to the water temperature leaving the heat exchanger.

The control system further preferably includes outside air temperature sensing means which causes the control system to respond to an increase in the outside air temperature by allowing the water temperature out of the heat exchanger to fall to a slightly lower temperature than normal while allowing water to continue to pass through the stand-by boiler water circuit.

As will be seen from the detailed description of a preferred embodiment of the invention which follows hereafter, the system is capable of recovering a substantial portion of the heat from the combustion gases which would otherwise be wasted. The increase in overall plant efficiency to be anticipated will of course depend upon the particular circumstances of each case but fuel savings in the order of 8 to 12% can probably be achieved in many cases. A further significant advantage is that the capital cost of new equipment is relatively small due to the fact that the system utilizes a stand-by boiler as the means for recovering heat from the exhaust gases. Basically, the only new equipment required involves some additional flue gas exhaust ducts, some additional piping and control valves together with a control system. The system to be described hereinafter is furthermore designed such that should the outside temperatures fall to the extent that the stand-by boiler is required for steam production, the necessary conversion can be made in a relatively short period of time.

The amount of heat recovered from the exhaust gases is of course dependent upon the temperature differential between the gases entering and the gases leaving the stand-by boiler. Since the gas exit temperature cannot be below the point at which deposition of harmful sulphur compounds from the fuel begins to occur, it will be appreciated that the amount of heat recovered will be primarily dependent upon the temperature of the incoming gases and the type of fuel used. Savings will thus be particularly noticable in higher pressure steam plants which, of necessity, must employ higher exhaust gas temperatures.

According to a still further aspect of the invention there is provided, in a method of operating a heating plant incorporating a plurality of steam boilers including a stand-by boiler wherein fuel and air are supplied to the burning means of at least one of said boilers, except for the stand-by boiler, there being flue gas exhaust ducts associated with each of said boilers, the improvement comprising recovering waste heat by circulating the flue gases exhausted from said at least one boiler through said stand-by boiler to cause the hot flue gases to pass in contact with the heat exchange surfaces thereof; circulating water through the stand-by boiler to effect the heating of such water whereby to recover a portion of the heat energy in the flue gases; and controlling the temperature of the water in the stand-by boiler above that necessary to avoid cooling of the flue gases within the stand-by boiler below the point at which significant condensation of certain flue gas components occurs on the heat exchange surfaces thereof.

BRIEF DESCRIPTION OF THE DRAWINGS

A preferred embodiment of the invention will now be described, reference being had to the accompanying drawings in which.

DETAILED DESCRIPTION OF THE PREFERRED EMBODIMENT

Figure 1:
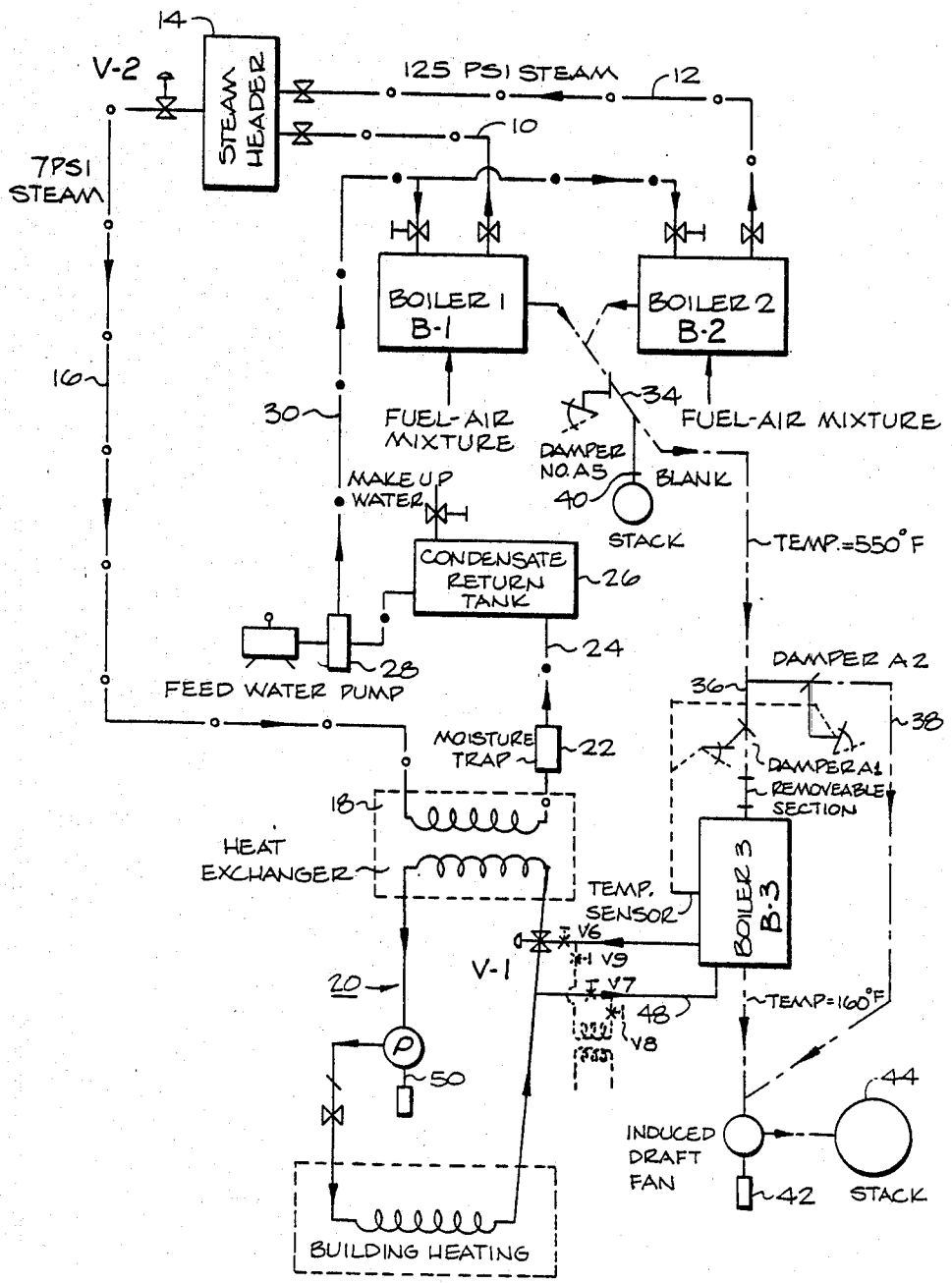
FIG. 1 is a schematic diagram of a heating plant incorporating a waste recovery system according to the invention.

With reference firstly to FIG. 1, there is shown a heating plant incorporating the principles of the present invention, which heating plant includes steam boilers B1, B2, and B3 of any suitable conventional construction. Boiler B3 is a stand-by boiler. Boilers B1 and B2 are, in operation, supplied with a fuel-air mixture in the usual fashion and produce steam which is carried through steam lines 10 and 12 to a steam header 14, such steam, in a typical case, being at 125 psi. pressure with such steam passing outwardly of the steam header via steam pipe 16, with such steam being reduced in pressure to the desired degree by means of a control valve V2. The steam thence passes into a heat exchanger 18 of any suitable conventional design with the heat from the steam being transmitted to a water heating system 20. A conventional steam trap 22 is provided, with the condensate passing via return line 24 to a condensate return tank 26. A feed water pump 28 supplies water at the required pressure to the boilers B1 and B2 via feed water line 30 in a conventional fashion. The stand-by boiler B3 is also provided with a suitable steam line which is connectable via conventional valve means to the steam header 14 and the same is also provided with condensate return lines and a feed water line and associated valving, all of which is not shown in FIG. 1 for purposes of simplicity.

Basically speaking, the system shown makes use of the heat from the flue gases being emitted from boilers B1 and B2, which previously went to atmosphere, to heat water in boiler B3 which, as noted above, is normally a stand-by boiler. This water which is heated in boiler B3 supplements the heat which is added to water heating system 20 and serves to increase the overall efficiency of the heating system. Accordingly, with boiler B1 and/or B2 operating to produce steam for processing and heating, the flue gases from boilers B1 and/or B2 are conducted through flue gas duct work 34 and into boiler B3 for the circulation therethrough of the hot flue gases in contact with the heat exchange surfaces of boiler B3 thereby to recover a portion of the heat energy in such gases. The flue gas exhaust duct 34 includes a first section 36 connected to and leading into the stand-by boiler B3 and a second section 38 which is capable of by-passing the flue gases around boiler B3. A damper A1 is positioned in the first duct section 36 and a second damper A2 is positioned in the by-pass duct portion 38. The position of dampers A1 and A2 is controlled by a control system which is responsive to a temperature sensor positioned in the hot water side of boiler B3 thereby controlling the proportions of flue gases being passed through the first and second duct sections 36 and 38. A further damper A5 is disposed in the flue gas duct 34 and provided with a suitable instrument control thereby to maintain the manufacturers recommended flue gas pressure at the outlet of boilers B1 and B2. In installations wherein a separate flue gas stack is provided for boilers B1 and B2, a blank 40 is placed in the entrance to such stack thereby to ensure passage of all flue gases toward boiler B3.

An induced draft fan 42 is provided downstream of boiler B3 and is of a size such as to maintain the desired flow and pressure of the flue gases passing through the system, with such flue gases ultimately passing outwardly through stack 44.

The temperature of the flue gases being emitted from boilers B1 and B2 will of course be dependent upon the pressure and temperature of the steam which they are generating and in the case where steam at a pressure of 125 psi. is being generated, flue gas temperatures in the order of 550° F. will be produced. Because of these high temperatures, the flue gas duct work 34 as well as flue gas duct sections 36 and 38 are well insulated thereby to minimize heat loss. In a typical case, sufficient heat is extracted from such flue gases in the stand-by boiler B3 as to cool the flue gases down to a temperature in the order of 145° to 180° F. Excessive cooling of the flue gases will result in the condensation of undesirable flue gas components on the heat exchange surfaces of boiler B3, such components including compounds of sulphur which can be very corrosive. Accordingly, in any particular operation, it will be necessary to analyze the flue gases and to determine the minimum allowable flue gas temperatures called for so as to avoid problems created by condensation of the flue gas components. Part of this control is exerted by the damper arrangements A1 and A2 referred to above and in addition means are provided for controlling the flow of water through boiler B3; such control means including control valve V1 and its associated control circuit to be referred to hereinafter. This control valve V1 is a three-way modulating valve which increases and decreases the flow of water through boiler B3 in accordance with increases and decreases respectively in the boiler water temperature. The stand-by boiler water circuit 48 is tied into the main water heating circuit 20 in the manner diagrammatically illustrated in FIG. 1. In cases where the stand-by boiler water temperature is relatively high, control valve V1 permits all or almost all of the water circulating in the main water heating circuit 20 to pass through boiler B3; under other circumstances, only a portion of the water passing through the heating circuit 20 passes through boiler B3 and, at start-up, when the water in boiler B3 is relatively cool, no water is allowed to circulate therethrough until such time as it has been brought up to the desired temperature. The water is made to circulate through the heating circuit by virtue of a suitable circulating pump 50 of conventional design. The water heating circuit 20 may of course include more than one circuit and for purposes of simplicity only a single circuit is illustrated in FIG. 1.

Figure 2:
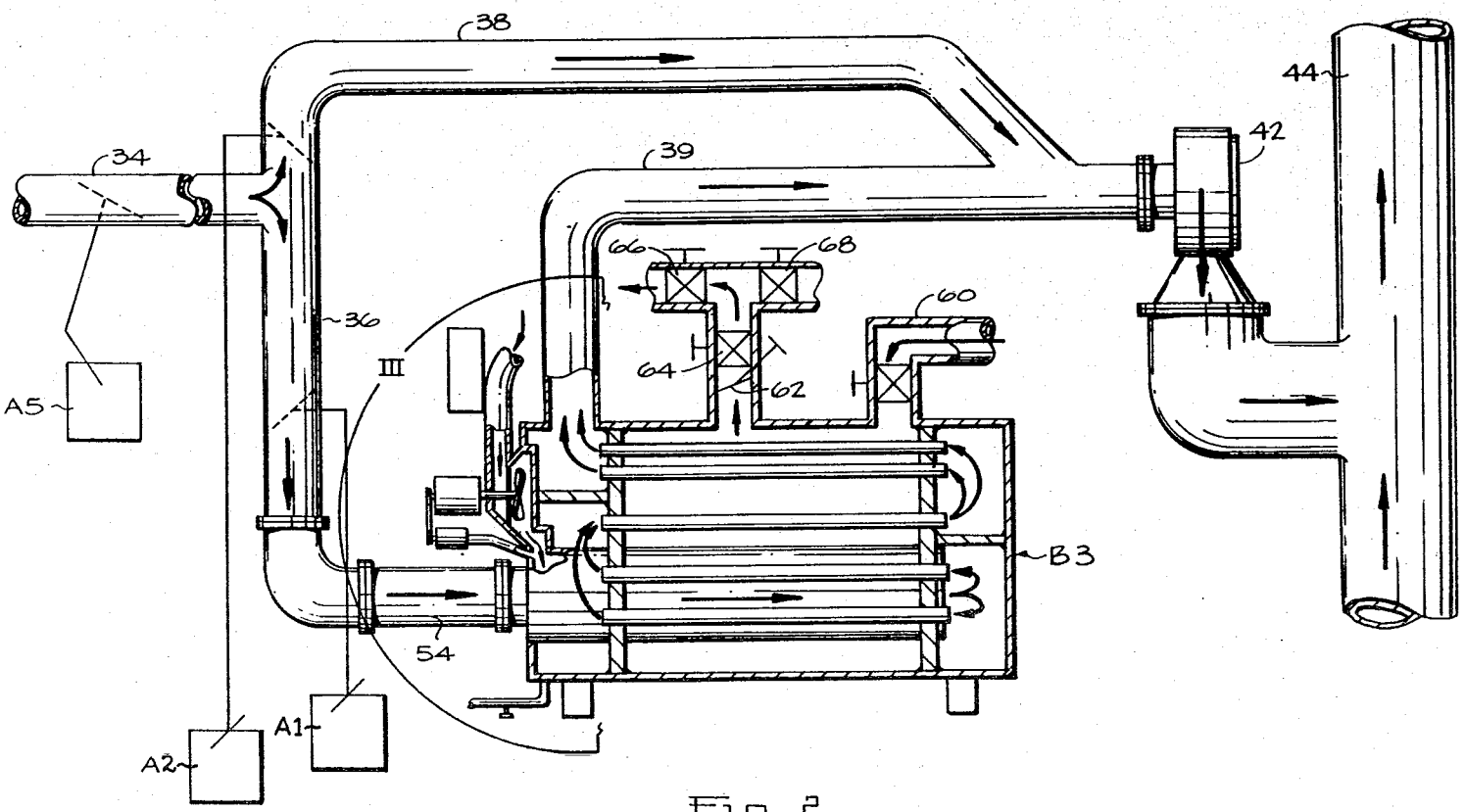
FIG. 2 is a somewhat diagrammatic sectional view of the stand-by boiler after it has been converted for waste heat recovery together with its associated duct work.
Figure 3:
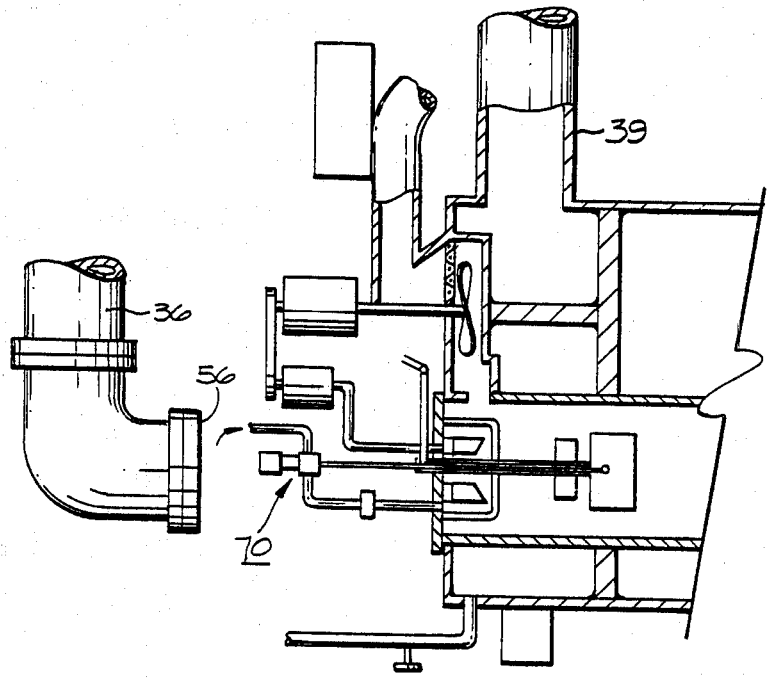
FIG. 3 is a partial sectional view of the stand-by boiler after the same has been converted over for use as a steam generator.

FIG. 2 illustrates boiler B3 and its associated flue gas duct work and the steam and water piping in further detail. The incoming flue gas duct 34 is shown along with its associated automatically controlled damper A5 for maintaining the recommended flue gas pressure in boilers B1 and B2. The first flue gas duct section 36 is illustrated along with its associated flow control damper A1 and leading into the combustion chamber section of boiler B3. Duct section 36 includes a removable portion 54 which is provided with flanged connections thereby to enable the same to be readily disconnected and removed and a conventional fuel firing assembly inserted and connected to boiler B3 as illustrated in FIG. 3. In this case a blank 56 is bolted to the end of duct section 36 thereby to prevent the escape of flue gases into the boiler room. With continued reference to FIG. 2, it will be seen that boiler B3 is of a conventional fire-tube design with the heated flue gases, after circulating through the boiler tubes and transmitting heat energy to the water contained in the boiler, thereafter passing outwardly through outlet duct 39 which thereafter is connected to the by-pass duct 38, with the combined flows thence passing into the induced draft fan 42 and thereafter being passed into the stack 44. The cooled water enters into boiler B3 through inlet 60 with such water, after being heated by the flue gases, rising through the stop and check valve 62, stop valve 64 and then through valve 66. If steam was being produced, the steam would go through valves 62, 64 and 68. When water is being heated the valve 68 is sealed shut and for steam heating the valve 66 is sealed shut.

It will be appreciated from an inspection of FIGS. 2 and 3 that it is very simple to convert the system from one mode of operation to another. If stand-by boiler B3 is to be utilized for the production of steam, it is only necessary to remove duct section 54 and to place the blank 56 in position, following which the oil burner assembly 70 is inserted into position ready for firing. The burner air supply and fuel oil atomizing compressor can in most installations remain in place throughout all operations and thus the oil burner is the only part removed from boiler B3 when it is desired to utilize the latter for waste heat recovery.

Figure 4:
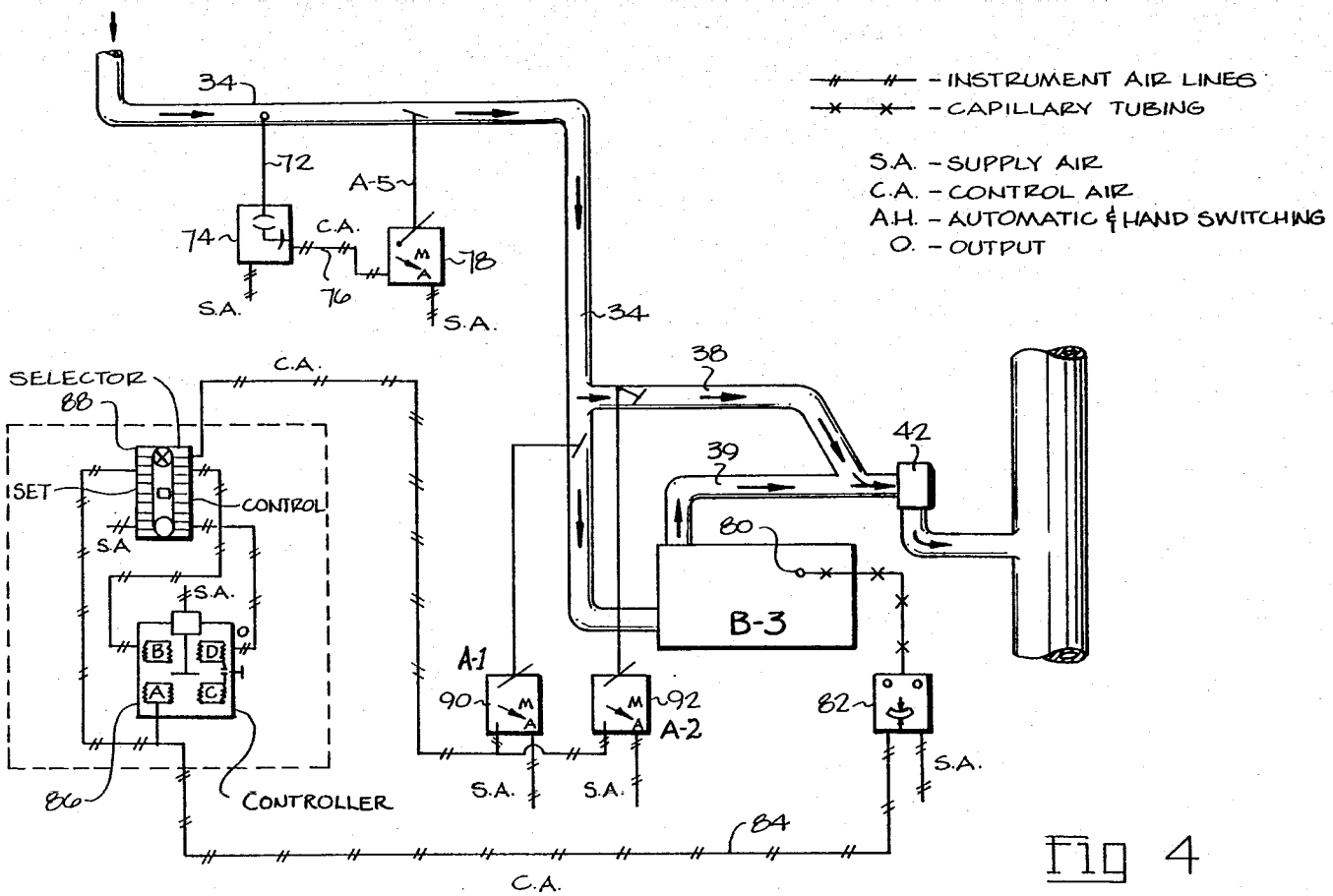
FIG. 4 is a somewhat diagrammatic view of the flue gas duct work and associated damper control system.

The various controls for duct work dampers A1, A2 and A5 are illustrated in FIG. 4. As described previously, the flue gases from boilers B1 and/or B2 passes through the duct work 34. In advance of the damper A5, there is disposed an impulse line 72 which transmits a pressure signal to a diaphragm operated draft controller 74 of any conventional design. This draft controller is designed to operate at a preselected set point and it sends a pneumatic air signal through control air line 76 to a conventional pneumatic drive positioner 78 which in turn positions the damper A5 so that the appropriate flue gas back pressure is maintained on boilers B1 and B2.

The control system for dampers A1 and A2 will now be described. A temperature sensing bulb 80 is located in the water section of boiler B3. Bulb 80 transmits a signal to a pneumatic temperature transmitter 82 having a predetermined set point. This transmitter sends an air signal via line 84 to a Bailey-type AD controller 86 at bellows A which is indicated at the Bailey selector. This controller sends an adjusted signal to the Bailey AJ5 selector. The output signal from the selector 88 goes to the pneumatic air drives 90 and 92 for dampers A1 and A2 respectively. The input signal for each drive is the same but the pneumatic drives are hooked up mechanically opposite to one another so that damper A1 opens with an increase in pneumatic signal while damper A2 closes with an increase in pneumatic signal. The dampers therefore function in a balanced fashion to assist in maintaining the water temperature in boiler B3 at a desired temperature. Those skilled in the art will realize that the above control system components are all of a conventional nature and are available commercially. The construction and operation of same will therefore be readily apparent to those skilled in the art in the light of the present disclosure.

Figure 5:
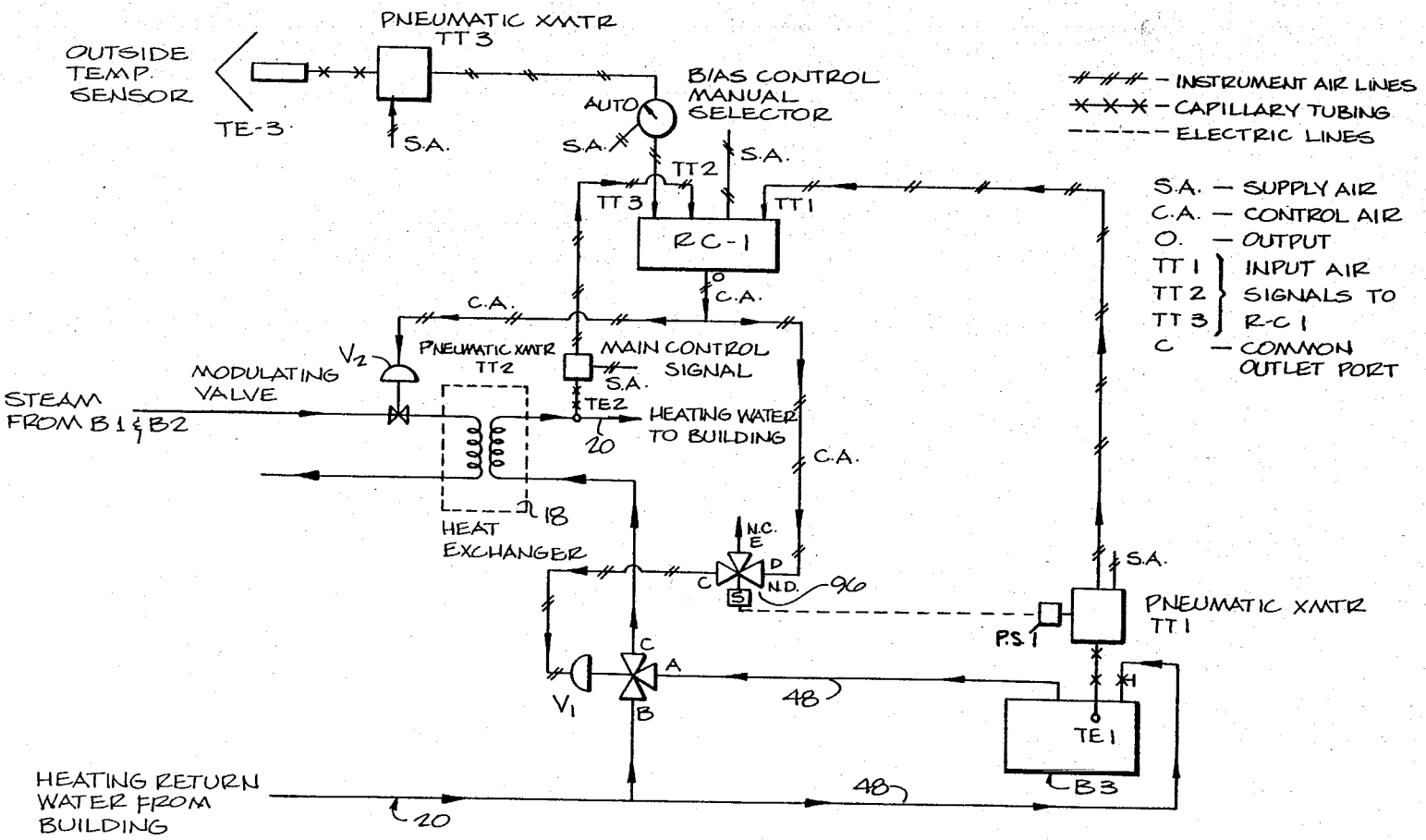
FIG. 5 is a schematic diagram of the control system for the steam and hot water flows.

FIG. 5 shows the control system for the steam and the hot water heating. The system includes a receiver controller RC1 which is of a suitable commercially available variety, e.g. a Johnson Model T9020-2. This receiver controller RC1 receives three signals. One signal TT1 is in response to the temperature of the water in boiler B3. Another signal TT3 comes from the outside air temperature sensor TE3. The main signal comes from the temperature sensor TE2 which senses the temperature of the water coming out of the heat exchanger 18 and moving toward the building to be heated. The output signal from receiver controller RC1 goes to the control valves V1 and V2. Valve V1 is a three-way modulating valve and is located on the hot water circulating line and is adapted to open in response to a pneumatic signal of 8 psi. and to close at 13 psi. Modulating valve V2 in the steam line from boilers B1 and B2 opens in response to a pneumatic signal 4 psi. and closes in response to a pneumatic signal of about 8 psi.

In operation, at the time of start-up, the water is cold in boiler B3 and the pressure switch PS1 is energized. Switch PS1 sends a signal to solenoid valve 96, the latter having three ports C, D and E. Under the influence of the signal from PS1, ports E and C of solenoid valve 96 are open while port D is closed thus preventing any signal from receiver controller RC1 from reaching modulating valve V1. Under these conditions, the flow of heating water returning from the building through circuit 20 passes through three-way valve V1 through port B and out port C; port A of valve V1 is closed under these conditions and hence no water can pass through boiler B3. Since the temperature sensed at TE2 in the heating water output to the building is low, then an air signal is put to receiver controller RC1 by way of input air signal TT2 which opens the steam valve V2 by means of output signal O, thus providing the required heat energy in the form of steam from boilers B1 and B2 to the heat exchanger 18.

As the water temperature rises at TE2, the air pressure signal generated by the receiver controller RC1 starts to shut steam valve V2. As the water temperature rises in stand-by boiler B3, the pressure switch PS1 de-energizes thus opening port D through C and closing port E on the solenoid valve 96. Control air from receiver controller RC1 now passes via solenoid valve 96 to the three-way modulating valve V1. In response to this valve port B starts to close while port A of valve V1 opens. This means that the water returning from the building can now pass through the boiler B3 thus enabling heat to be extracted from the flue gases circulating therethrough. The water heated in boiler B3 thus passes through valve V1 via ports A and C and then passes on into the heat exchanger 18. The main control sensor TE2 now takes over to open and close valves V1 and V2 thereby to regulate the steam flow from boilers B1 and B2 and the water flow through the boiler B3.

The above-noted sensor TE3 which measures the outside air temperature adjusts the set point of TE2 slightly to give a type of trimming control. For example, if the outside air temperature goes up 20° F., then the set point of TE2 would lower slightly (in the order of a few degrees F.) to allow lower temperature heating water to flow throughout the building thus keeping boiler B3 supplying hot water to the system via ports A and C on control valve V1 for a longer period than would otherwise be the case. (Pneumatic transmitter TT3 is in fact a reset pneumatic controller with a variable ratio set point. This can be set for different applications to gain maximum effect of varying outside temperatures. The variable ratio can be higher than a 5:1 gain.)

The pneumatic transmitter TT3 which is connected to sensor TE3 can be put on manual control to adjust the set point if necessary.

It should be realized when reading the above description that three-way valve V1 is a modulating valve throughout the air pressure operating range of 8 psi. to 13 psi. Thus, under various conditions, some of the heating water returning from the building system can pass through ports B and C on valve B1 with the remaining return water passing through boiler B3 and then through ports A and C on valve V1 at the same time thus maintaining the temperature of the water passing through boiler B3 within the desired temperature range. It will also be understood that although the damper control system illustrated in FIG. 4 is separate from the steam and hot water control system illustrated in FIG. 5 that the two systems do in fact cooperate with one another to maintain the various flows in the system at levels such as to ensure the desired operating temperatures and optimum waste heat recovery values.

In the summer months when the building heating load is small or non-existant, the energy from the flue gas can be made use of for heating domestic hot water for showers, baths etc.—which is quite a saving especially in a hospital. Valves V6, V7, V8 and V9 are used to put a heat exchanger for domestic hot water in service. This alternative system is shown in phanton in FIG. 1. By shutting valves V6 and V7 and opening valves V8 and V9 the domestic hot water heating is put into effect.

Also in some installations where there is an incinerator some of the classified waste flue gas could be used as a heating medium in boiler B3. The incinerator flue can be connected to flue gas duct 34 at any convenient location along its length.

A preferred embodiment of the invention has been described by way of example. Those skilled in the art will realize that numerous changes may be made to the details of construction without departing from the spirit or scope of the invention as hereinafter claimed.

I claim:

1. A heating plant incorporating at least one boiler, means for supplying fuel and air to said at least one boiler, a flue gas exhaust duct associated with said at least one boiler, the heating plant including a waste heat recovery unit having heat exchange surfaces therein and wherein the flue gas exhaust duct from said at least one boiler is operatively connected to said waste heat recovery unit for the circulation therethrough of hot flue gases in contact with the heat exchange surfaces thereof, means to allow flow of fluid through said waste heat recovery unit thereby to recover a portion of the heat energy in the flue gases; a heat exchanger; and a primary circuit connecting said at least one boiler in flow relation to said heat exchanger for the conveyance of the heat output of said at least one boiler thereto, a first fluid heating circuit being operatively connected to the heat exchanger, a second fluid circuit for connecting the waste heat recovery unit in flow relation with said first fluid heating circuit; control means including a control system and first and second control valve means for regulating, respectively, the flow through said primary circuit and the flow through the second fluid circuit to provide a desired temperature in the fluid flowing out of the heat exchanger via said first fluid heating circuit while assisting in maintaining the fluid flowing through the second fluid circuit and the waste heat recovery unit above that temperature necessary to avoid excessive cooling of the flue gases within the waste heat recovery unit and consequent condensation of certain flue gas components on the heat exchange surfaces thereof, and wherein the control system is responsive both to the temperature of the fluid in the heat recovery unit and to the temperature of the fluid flowing from the heat exchanger via said first fluid heating circuit, said control system acting to substantially eliminate fluid flow through the second fluid circuit and the heat recovery unit when the temperature of the fluid in the latter is below a minimum selected temperature, and, after the minimum selected fluid temperature is reached, said control system being primarily responsive to the temperature of the fluid flowing out of the heat exchanger via said first fluid heating circuit.

2. A heating plant incorporating a plurality of boilers, including a stand-by boiler, means for supplying fuel and air to at least one of said boilers, except for the stand-by boiler, and flue gas exhaust ducts associated with each of said boilers, the heating plant including a waste heat recovery system wherein the flue gas exhaust duct from said at least one boiler is operatively connected to said stand-by boiler for the circulation therethrough of hot flue gases in contact with the heat exchange surfaces thereof to effect the heating of water passing through the stand-by boiler, thereby to recover a portion of the heat energy in the flue gases; a heat exchanger, and a primary circuit connecting said at least one boiler in flow relation to said heat exchanger for the conveyance of the heat output of said at least one boiler thereto, a first water heating circuit being operatively connected to the heat exchanger, a second water circuit for connecting the stand-by boiler in flow relation with said first water heating circuit; and control means including a control system and first and second control valve means for regulating, respectively, the flow through said primary circuit and the flow through the second water circuit to provide a desired temperature in the water flowing out of the heat exchanger via said first water heating circuit while assisting in maintaining the water flowing through the second water circuit and the stand-by boiler above that temperature necessary to avoid excessive cooling of the flue gases within the stand-by boiler and consequent condensation of certain flue gas components on the heat exchange surfaces thereof, and wherein the control system is responsive both to the temperature of the water in the stand-by boiler and to the temperature of the water flowing from the heat exchanger via the first water heating circuit, said control system acting to substantially eliminate water flow through the second water circuit and the stand-by boiler when the temperature of the water is below a minimum selected temperature.

3. A method of operating a heating plant incorporating a plurality of boilers including a stand-by boiler, means for supplying fuel and air to the burning means of at least one of said boilers, except for the stand-by boiler, flue gas exhaust ducts associated with each of said boilers, said at least one boiler being connected via a steam line to a heat exchanger, a first water heating circuit operatively connected to said heat exchanger to receive heat output from said at least one boiler, and a second water circuit means for connecting the stand-by boiler in flow relationship with said first water heating circuit, the method comprising recovering waste heat by circulating flue gases exhausted from said at least one boiler through said stand-by boiler to cause the hot flue gases to pass in contact with the heat exchange surfaces thereof; circulating water through the stand-by boiler to effect the heating of such water whereby to recover a portion of the heat energy from the flue gases; regulating the steam flow through said steam line and regulating the water flow through the second water circuit means to provide a selected temperature in the water outflow from said heat exchanger via said first water heating circuit and to assist in maintaining the water flowing through the stand-by boiler above that temperature necessary to avoid cooling of the flue gases within the stand-by boiler below the point at which significant condensation of certain flue gas components occurs on the heat exchange surfaces thereof, the method further including the steps of sensing stand-by boiler water temperature and sensing the temperature of the water flowing out of the heat exchanger via said first water heating circuit, and controlling the flows such that water flow through the stand-by boiler via said second water circuit means is nil when the stand-by boiler water temperature is below a minimum selected temperature, as at start-up, and after the minimum selected stand-by boiler water temperature is reached, the flow of steam through said steam line and the flow of water through the stand-by boiler via said second water circuit means being primarily controlled by the water temperature out of the heat exchanger.

4. The system according to claim 1 wherein said control means further includes outside air temperature sensing means which causes the control system means to respond to an increase in the outside air temperature by allowing the temperature of the fluid flowing out of the heat exchanger via the first fluid heating circuit to fall to a slightly lower temperature while allowing fluid to continue to pass through the second fluid circuit and the heat recovery unit.

5. The system according to claim 1 or 4 wherein the flue gas exhaust duct from said at least one boiler includes a first section connected to and leading into the heat recovery unit and a second section which is capable of by-passing the flue gases around the heat recovery unit, said control means further including damper means disposed in the exhaust duct for controlling the proportions of flue gases to be passed through said first and second sections and means responsive to the temperature of the fluid passing through the heat recovery unit via said second fluid circuit and operatively connected to said damper means for controlling the amount of flue gases passing through the heat recovery unit.

6. The system according to claim 25 wherein, after the minimum selected water temperature is reached, said control system is primarily responsive to the temperature of the water flowing out of the heat exchanger via the first water heating circuit.

7. The system according to claim 2 wherein said at least one boiler is a steam generator for supplying steam via said primary circuit to said heat exchanger, and said first water heating circuit is a building water heating circuit.

8. The system according to claim 6 wherein said at least one boiler is a steam generator for supplying steam via said primary circuit to said heat exchanger, and said first water heating circuit is a building water heating circuit.

9. The system according to claims 2, 6, 7 or 8 wherein the flue gas exhaust duct from said at least one boiler includes a first section connection to and leading into the stand-by boiler and a second section which is capable of by-passing the flue gases around the stand-by boiler, said control means further including damper means disposed in the exhaust duct for controlling the proportions of flue gases to be passed through said first and second sections and means responsive to the temperature of the water passing through the stand-by boiler via said second water circuit and operatively connected to said damper means for controlling the amount of flue gases passing through the stand-by boiler.

10. The system according to claim 9 wherein the first section of the exhaust duct is connected to the stand-by boiler to lead the exhaust gases into the combustion chamber thereof, the first section of the exhaust duct having a removable portion therein arranged to permit the first section to be disconnected and closed off to enable a fuel firing assembly to be operatively brought into comunication with the combustion chamber of the stand-by boiler as when the latter is required to produce steam.

11. The system according to claim 9 wherein said control means further includes outside air temperature sensing means which causes the control system means to respond to an increase in the outside air temperature by allowing the temperature of the water flowing out of the heat exchanger via the first water heating circuit to fall to a slightly lower temperature while allowing water to continue to pass through the second water circuit and the stand-by boiler.

12. The method according to claim 3 wherein the flue gases exhausted from said at least one boiler are caused to pass through a first exhaust duct section connected to and leading into the stand-by boiler and/or a second exhaust duct section which is capable of by-passing the flue gases around the stand-by boiler; the method further including controlling the proportions of flue gases being passed through said first and second exhaust duct sections in response to the temperature of the water passing through the stand-by boiler to assist in maintaining the latter temperature above the desired level.

13. The method according to claim 3 or 12 including sensing the outside air temperature and, in response to an increase in the outside air temperature allowing the temperature of the water flowing out of the heat exchanger via said first water heating circuit to fall to a slightly lower temperature while allowing water to continue to pass through the stand-by boiler water via said second water circuit means.

* * * * *